US005239727A

United States Patent [19]

Roestenberg

[11] Patent Number: 5,239,727

[45] Date of Patent: Aug. 31, 1993

[54] CENTRAL VACUUM SYSTEM

[76] Inventor: Jerome R. Roestenberg, 11 Woodpecker La., Levittown, N.Y. 11756

[21] Appl. No.: 803,194

[22] Filed: Dec. 5, 1991

[51] Int. Cl.[5] ..... A47L 5/00

[52] U.S. Cl. ..... 15/315; 15/314; 15/353

[58] Field of Search ..... 15/314, 340.1, 315, 15/353

[56] References Cited

U.S. PATENT DOCUMENTS

| | | | |
|---|---|---|---|
| 1,055,977 | 3/1913 | Lasley | 15/315 X |
| 1,970,674 | 8/1934 | Seibert et al. | 15/314 |
| 2,772,438 | 12/1956 | Diaz | 15/314 |
| 3,150,404 | 9/1964 | Johnson | 15/314 X |
| 3,381,327 | 5/1968 | Kelley | 15/314 |
| 3,594,848 | 1/1971 | Atkinson | 15/340.1 X |
| 4,366,594 | 1/1983 | Hyams | 15/314 |
| 4,540,202 | 9/1985 | Amphoux et al. | 15/314 X |

*Primary Examiner*—Chris K. Moore

*Attorney, Agent, or Firm*—Nolte, Nolte and Hunter

[57] ABSTRACT

A central vacuum system for workspaces such as auto body or wood shops. A vacuum generating unit is rotatably mounted at a level above the heads of the shop workers and integrated with a rigid boom having a flexible vacuum hose at its distal end such that the boom may be swung in an arc parallel to the floor space and thereby give access to the vacuum over a wide area. In a preferred embodiment, the boom is hinged at its center so as to facilitate access to the vacuum within the radius of the arc.

13 Claims, 4 Drawing Sheets

CENTRAL VACUUM SYSTEM

BACKGROUND OF THE INVENTION

This invention concerns a central vacuum system for workspaces where large quantities of dust and debris are generated such as in auto body or wood shops. A vacuum generating unit is rotatably mounted at a level above the heads of the shop workers and integrated with a rigid boom having a flexible hose at the distal end such that the boom may be swung in a plane parallel to the floor. In a preferred embodiment, the boom is hinged at or near its center thereby providing access to the vacuum source throughout a generally circular workspace, the radius of which is defined by the lengths of the boom and circular hose.

Central vacuum systems currently in use generally consist of a fixed vacuum unit connected to a network of pipes. Because of the extensive length of pipe needed for such systems, there is pressure loss from numerous small leaks and access ports inadvertently left open. Also, drag develops between incoming air and the walls of the piping. As a result, powerful vacuum generators are required, often equipped with booster pumps for additional power. All this equipment takes up space and consumes large amounts of electricity.

The present invention eliminates the need for bulky pump units by eliminating most of piping needed in conventional systems.

DETAILED DESCRIPTION OF THE DRAWINGS

Figures 1, 1A:
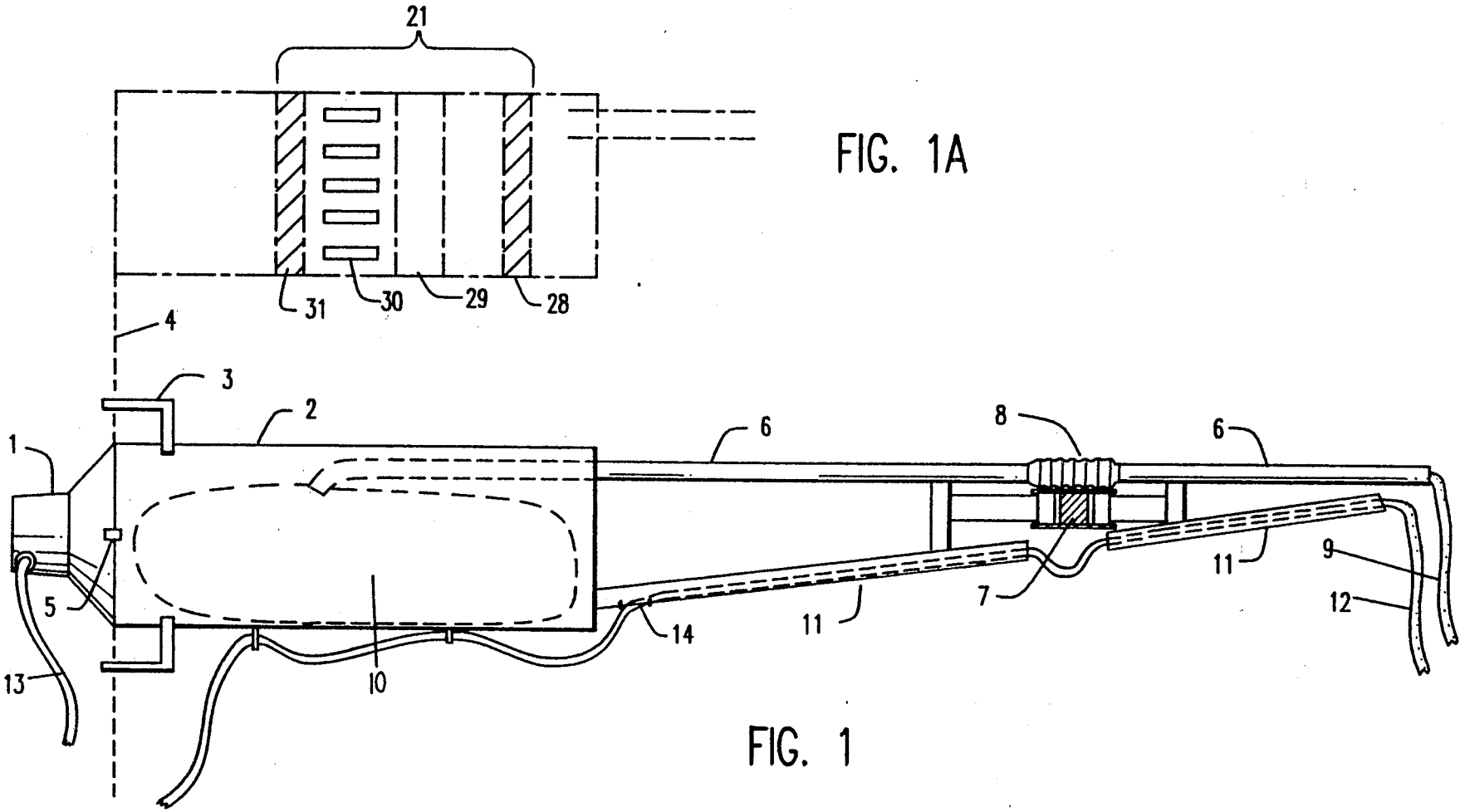
FIG. 1 is a side view of the invention.
FIG. 1A is a side phanton view of a variation of the invention.

FIG. 1 shows the preferred embodiment of the present invention. a vacuum unit is created by mounting an air pump unit 1 to the open end of a hollow cylindrical chamber 2 with latches 5. The vacuum unit is provided with a mounting assembly 3 to permit rotation about a vertical axis 4. Extending from the vacuum unit is a conduit or vacuum boom 6 which is preferably pivoted near its center with a suitable hinge assembly 7. The gap between the two sections of the vacuum boom 6 is bridged with a section of flexible hose 8. Hanging from the distal end of the vacuum boom is a flexible vacuum hose 9 which descends toward the floor of a workspace. Material sucked into the vacuum hose 9 thereby travels along the vacuum boom conduit and is deposited in a collection bag 10.

In the preferred embodiment, a carrier boom 11 is provided for structural strength and to carry a pressurized air hose 12 to the workspace. The hollow core of the carrier boom 11 is sealed off from the chamber 2 and an exit hole 14 provided near the juncture therewith to allow the air hose 12 to be run along the outside of the chamber. Of course, this feature of the invention is not to be limited to pressurized air. Water hoses, electric power or signal lines, or gas lines could also be run through the carrier boom or even simply strapped to the outside of it.

It can now be seen that a source of vacuum in addition to any number of other utilities can be made available to a circular area of a workspace by mounting the system high enough for the booms to clear the workers' heads or any other obstacles that would impede rotation. The area covered is limited only by the length of the booms 6, 11 and hoses 9, 12.

It is also understood that one of the advantages of this system is that the entire vacuum unit rotates with the boom assembly. Hence, there is no need for a rotatable link between the vacuum boom and the vacuum unit which would inevitably be subject to leakage.

Figure 2:
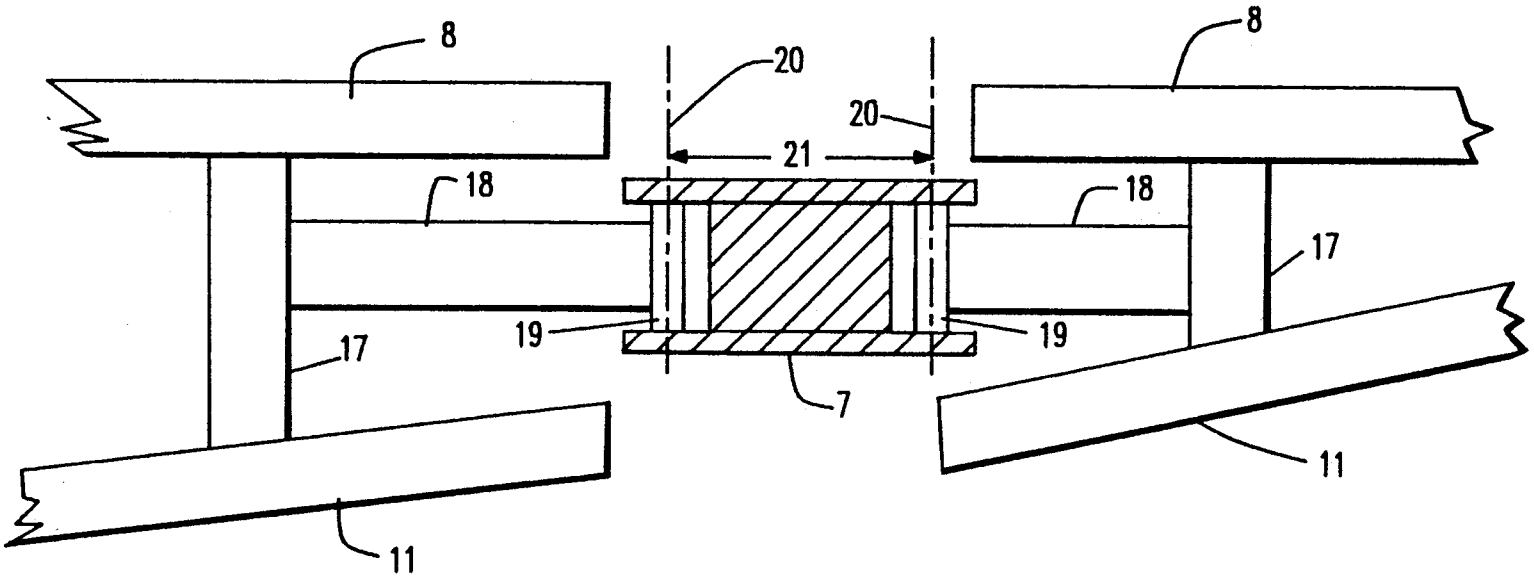
FIG. 2 is a closeup view of the hinge of FIG. 1.

In FIG. 2 it is seen that the preferred embodiment for the hinge assembly is one having dual axes of rotation 20. Flexible hose 8 and air hose 12 have been removed for clarity. Brace members 17 act to space the vacuum boom 6 and carrier boom 11 and to provide support for extension members 18. At the distal end of each extension member is a pivot unit 19 comprising, in this case, a cylinder with a hole bored through it along the axis of rotation 20 for receiving a bolt or other axle element (not shown). The hinge assembly 7 has an H shaped unit adapted to fit closely with the pivot units and also having bores on each of its four extensions in alignment with the axes of rotation 20 to receive bolts or other axle elements.

It can now be seen that so long as the distance 21 between the axes of rotation 20 is equal to or greater than the width of the larger of the booms (in this case, the vacuum boom 6 is larger than the carrier boom), then the entire boom assembly can be completely folded back upon itself to provide vacuum and utilities to the workspace beneath the vacuum unit itself. Of course, the boom assembly need not be limited to a single hinge assembly to achieve this objective. Note also that some or all of the sections of the boom assembly may be modified to "telescope" if desired.

Figure 3:
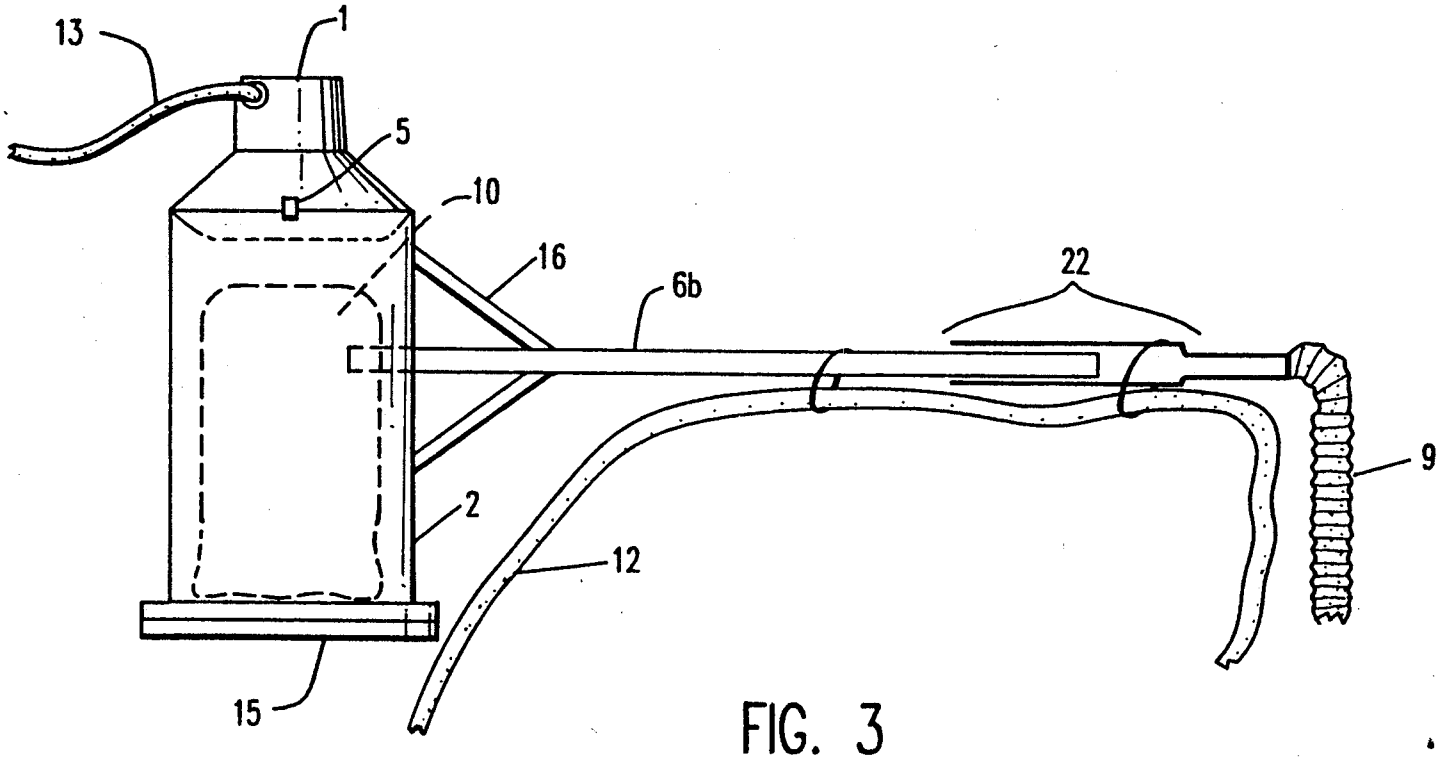
FIG. 3 is a side view of a second embodiment of the invention.

FIG. 3 shows additional embodiments for the rotatable mounting of the vacuum unit and for the boom assembly. Here, the vacuum unit is vertically mounted upon a turntable 15 and the vacuum boom **6*b* is attached to the side of the chamber 2. Optional telescoping means 22 are depicted. In this less expensive version there is no carrier boom so support members 16 are provided and air lines 12 or other utilities are strapped to the vacuum boom. This embodiment is not preferred for very large workspaces since to provide vacuum directly under the vacuum unit would require a very long vacuum hose 9** which results in increased drag. This embodiment of the boom assembly is, however, less expensive, easier to produce, and suitable for small areas such as a single garage.

Figure 4:
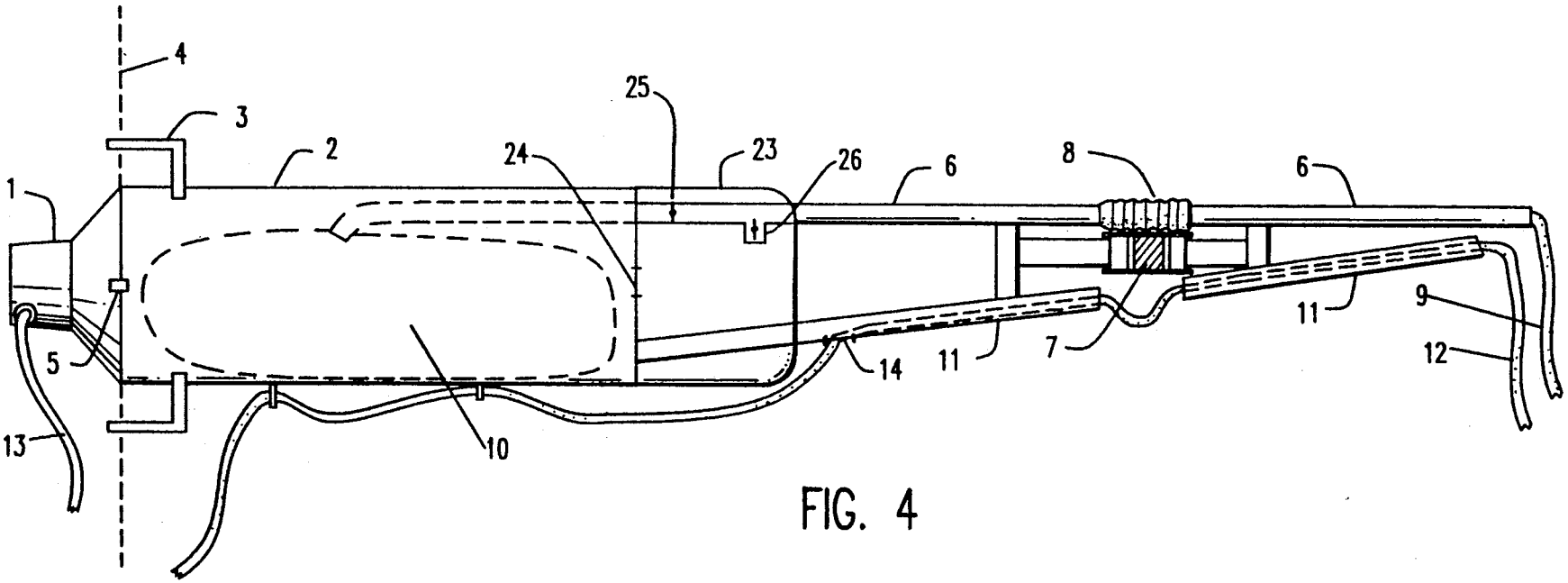
FIG. 4 is a side view of a variation of the invention.

FIG. 4 shows an additional wet-vacuum variation on FIG. 1 for the vacuuming of water. Added to the main chamber 2 is an additional chamber 23 which is preferably made of a clear plastic. Chamber 23 is in vacuous communication with the main chamber through a small opening 24. A plurality of valves 25 and 26 are provided to enable the operator to switch between liquid vacuum use and conventional vacuum use. Valve 25 is shown closed and valve 26 open so that liquids being brought up through the tube will drop down through valve 26 and fill the chamber 23. The two valves can be mechanically connected so that they turn simultaneously or, alternatively, a single specially adapted valve could be placed at the T junction where valve 26 is. This invention is not to be limited to any particular valve configuration.

Lastly, FIG. 1A depicts an embodiment in phantom that can be adapted to any of the previous embodiments in which the collector bag assembly is replaced with an electrostatic precipitator 27. Such a system is useful in the vacuuming of hazardous particles which are typically generated by modern welding operations on metal alloys. Though my invention is not limited to any particular configuration of precipitator, a typical configuration is shown wherein gases entering chamber 2 through vacuum boom 6 pass through a prefilter 28 which removes large particulate matter. The gases then pass through a plurality of ionizer plates 29 which are charged to very high voltage. This ionizes the particles passing through which then are attracted to a plurality of collector plates 30, here shown at right angles to the ionizer plates, which are charged to an opposite plurality of the ionized particles thereby attracting them. The remaining gases then pass through an after-filter 31 before being jettisoned outside of the system by the air pump unit.

In all events the invention is not to be considered as restricted to the embodiments disclosed but only by the claims appended hereto.

I claim:

1. A central vacuum system for providing vacuum to operators in a workspace confined within the walls, floor and ceiling of a work room, comprising:

a cylindrical housing;

means for generating a vacuum in said cylindrical housing;

a rigid vacuum boom integral with and extending a substantial distance along a rectilinear axis from said cylindrical housing to a distal end thereof and comprising a conduit in communication with said cylindrical housing and with vacuum generated therein;

means rigidly connecting said vacuum boom to said cylindrical housing;

means for mounting said cylindrical housing adjacent a wall surface within the work room for rotation of said housing and said vacuum boom about a vertical axis; and means for adjusting the distance between said mounting means and said distal end of said boom.

2. The invention of claim 1 further comprising a flexible vacuum hose attached to said distal end of said boom for transferring vacuum to areas in said workspace below said boom.

3. The invention of claim 1 wherein said adjusting means comprise a discontinuity in said boom bridged by a flexible conduit continuing and in communication with said conduit of said boom and hinge means bridging said discontinuity for pivoting said distal end toward said mounting means by folding said conduit upon itself.

4. The invention of claim 3 wherein said hinge means comprises a plurality of hinged joints mounted on said boom on either side of said discontinuity.

5. The invention of claim 1 wherein a carrier boom is rigidly secured to and extends from said housing in the same general direction as, and in side-by-side and spaced relation to said vacuum boom and having a distal end in proximity to said distal end of said vacuum boom, said carrier boom comprising means for strengthening said vacuum boom.

6. The invention of claim 5 wherein said central vacuum system further comprises utility lines running from the vicinity of said mounting means to said distal end of said carrier boom and said carrier boom comprises means for supporting said utility lines.

7. The invention of claim 5 wherein said adjusting means comprises a discontinuity in said vacuum boom and discontinuity in said carrier boom, hinge means bridging both discontinuities for pivoting both said distal ends toward said mounting means, and means bridging the space between said vacuum boom and said carrier boom for mounting said hinge means to said booms.

8. The invention of claim 1 wherein said mounting means comprises a turntable, said cylindrical housing extends along an axis and is disposed on said turntable with its axis extending vertically.

9. The invention of claim 1 wherein said adjusting means comprises a telescoping assembly in said vacuum boom.

10. A central vacuum system for providing vacuum to a workspace confined within the walls, floor and ceiling of a work room comprising:

a hollow chamber;

an air pump unit;

said air pump unit removably mounted on said chamber in a manner effective in pumping air out of said chamber;

a vacuum boom having a near end and a distal end and comprising a tube defining a hollow core;

a rim defining an opening in said chamber to receive said vacuum boom;

said near end of said vacuum boom extending through the opening and hermetrically sealed to said rim such that air entering said chamber must pass through the hollow core;

a collection bag placed within said chamber and adapted to fit over said near end of said vacuum boom extending into said chamber as means for collecting particles sucked into said chamber;

means for mounting said chamber such that said chamber will rotate in a manner to cause said distal end of said vacuum boom to sweep out an arc located in a plane substantially parallel to said floor of said workspace and at a height above said floor effective in avoiding workers and obstacles;

flexion means in said vacuum boom for bending said boom intermediate its ends and comprising a section of flexible hose bridging a discontinuity in said vacuum boom; and hinge means for rigidly bridging the discontinuity for folding said vacuum boom upon itself.

11. The invention of claim 1 further comprising a flexible vacuum hose attached to said distal end.

12. A central vacuum system for providing vacuum to a workspace confined within the walls, floor and ceiling of a work room comprising:

a hollow chamber;

an air pump unit;

said air pump unit removably mounted on said chamber in a manner effective in pumping air out of said chamber;

a vacuum boom having a near end and a distal end and comprising a tube defining a hollow core;

a rim defining an opening in said chamber to receive said vacuum boom;

said near end of said vacuum boom extending through the opening and hermetrically sealed to said rim such that air entering said chamber must pass through the hollow core;

a collection bag placed within said chamber and adapted to fit over said near end of said vacuum boom extending into said chamber as means for collecting particles sucked into said chamber;

means for mounting said chamber such that said chamber will rotate in a manner to cause said distal end of said vacuum boom to sweep out an arc located in a plane substantially parallel to said floor of said workspace and at a height above said floor effective in avoiding workers and obstacles;

a wet-vacuum chamber in vacuous communication with said hollow chamber, and valve means for redirecting fluids passing through said vacuum boom into said wet-vacuum chamber.

13. The invention of claim 1 wherein said cylindrical housing extends along an axis and extends from said mounting means when mounted on a wall surface with its axis extending horizontally.

* * * * *